US007921566B2

(12) United States Patent
Yamaguchi et al.

(10) Patent No.: US 7,921,566 B2
(45) Date of Patent: Apr. 12, 2011

(54) HAIR TRIMMER

(75) Inventors: Takashi Yamaguchi, Osaka (JP); Hitoshi Ogawa, Osaka (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 690 days.

(21) Appl. No.: 11/016,851

(22) Filed: Dec. 21, 2004

(65) Prior Publication Data

US 2005/0138817 A1 Jun. 30, 2005

(30) Foreign Application Priority Data

Dec. 26, 2003 (JP) ..... 2003-435231

(51) Int. Cl.
*B26B 19/20* (2006.01)

(52) U.S. Cl. ..... 30/233.5; 30/201; 30/200; 30/202; 30/233; 30/216

(58) Field of Classification Search ..... 30/233.5, 30/201, 200, 195, 202, 233, 32, 34.05, 196, 30/34.2, 35, 41.9, 43, 43.1, 216; D28/49–54; 132/137, 142, 157, 139; 15/187
See application file for complete search history.

(56) References Cited

U.S. PATENT DOCUMENTS

| | | | | | |
|---|---|---|---|---|---|
| 592,770 | A | * | 11/1897 | Faracchio | 30/201 |
| 1,649,999 | A | * | 11/1927 | Yancy et al. | 30/201 |
| 1,691,270 | A | * | 11/1928 | Donnellon | 30/201 |
| 1,716,465 | A | * | 6/1929 | Roberts | 30/201 |
| 2,187,599 | A | * | 1/1940 | Cromonic | 30/201 |
| 2,256,076 | A | * | 9/1941 | Coles | 30/34.05 |
| 3,344,520 | A | * | 10/1967 | Williams | 30/200 |
| 3,969,819 | A | * | 7/1976 | Pepera | 30/200 |
| 4,614,036 | A | | 9/1986 | Haraguchi et al. | |
| 4,763,675 | A | * | 8/1988 | DeFelice | 132/137 |
| 4,807,652 | A | * | 2/1989 | Bachrach | 132/137 |
| 5,050,305 | A | * | 9/1991 | Baker et al. | 30/201 |
| 6,279,234 | B1 | * | 8/2001 | Chaouachi et al. | 30/201 |
| D499,844 | S | * | 12/2004 | Muramatsu | D28/53 |
| 7,100,286 | B2 | * | 9/2006 | Nakakura et al. | 30/201 |
| 2002/0073550 | A1 | * | 6/2002 | Long et al. | 30/41.6 |

FOREIGN PATENT DOCUMENTS

| | | |
|---|---|---|
| EP | 0928670 | 7/1999 |
| EP | 1216799 | 6/2002 |
| JP | 53-064687 | 5/1978 |
| JP | S60-108074 | 6/1985 |
| JP | S60-215387 | 10/1985 |
| JP | H01-212588 | 8/1989 |

* cited by examiner

*Primary Examiner* — Ghassem Alie
(74) *Attorney, Agent, or Firm* — Bacon & Thomas, PLLC

(57) ABSTRACT

A hair trimmer includes a main body, a cutter block and a comb attachment. The cutter block has a stationary blade and a movable blade, both of which are comb-shaped and are slidably in contact with each other. In addition, the cutter block is protrudingly installed at one end of the main body. The comb attachment has a plurality of comb tooth-shaped sections and covers the cutter block. The comb tooth-shaped sections are provided with cut-off hair deflectors to prevent hairs cut by the cutter block from outwardly scattering away from the comb attachment. Furthermore, cut-off hair deflectors located between two neighboring comb tooth-shaped sections are disposed at relatively inner and outer positions.

21 Claims, 12 Drawing Sheets

HAIR TRIMMER

FIELD OF THE INVENTION

The present invention relates to a hair trimmer; and, more particularly, to a technique for preventing cut-off hairs from scattering out when hairs or beards brought in from a comb tooth-shaped section of a comb attachment covering a cutter block is cut by a stationary blade and a movable blade, both of which are comb-shaped and are slidably in contact with each other.

BACKGROUND OF THE INVENTION

Japanese Patent Laid-open Application No. H1-214388 (hereinafter refer to as "Patent 1") discloses therein a trim length adjusting structure for a conventional hair trimmer. In the conventional example described in Patent 1, a cutter block consisting of a stationary and a movable blade, both of which are comb-shaped and slidably in contact with each other, is protrudingly disposed at one end portion of a main body. A cylindrical comb attachment for trim length adjustment, having a plurality of comb tooth-shaped sections, is movably engaged at the portion of the main body where the cutter block is disposed and along the projected direction of the cutter block. By rotating a cylindrical adjustment element rotatably and movably disposed around the main body, the comb attachment in a comb shape is movable in the projected direction of the cutter block.

Further, hairs or beards brought in from hair introducing gaps between the comb tooth-shaped sections of the comb attachment come in contact with the stationary blade in a comb shape and then cut by the movable blade at a desired cutting length.

However, in the conventional example above, loose cut-off hairs can easily scatter out through the hair introducing gaps between the comb tooth-shaped sections of the comb attachment, and then disperse ultimately to litter the surrounding area. The comb tooth-shaped sections of the comb attachment are designed to allow hairs to be trimmed to go through the hair introducing gaps smoothly so that they can reach the blades without obstruction. Similarly, once hairs are trimmed, cut-off hairs can also easily scatter out randomly through the hair introducing gaps.

SUMMARY OF THE INVENTION

The present invention has been developed to solve the above-described conventional problems of the conventional hair trimmer discussed above. Accordingly, an object of the present invention is to provide a hair trimmer having a simple structure capable of controlling and preventing cut-off hairs from scattering out randomly and being dispersed into the surrounding area while smoothly bringing in hairs for trimming. Thus, hairs can get in through the hair introducing gaps just as easily as the conventional hair trimmer, but cut-off hairs' getting out through the gaps is made much more difficult.

In accordance with the present invention, there is provided a hair trimmer including: a main body; a cutter block having a stationary blade and a movable blade, both of which are comb-shaped and are slidably in contact with each other, the cutter block being protrudingly installed at one end of the main body; and a comb attachment having a plurality of comb tooth-shaped sections and covering the cutter block, wherein the comb tooth-shaped sections are provided with cut-off hair deflectors to prevent hairs cut by the cutter block from outwardly scattering away from the comb attachment, cut-off hair deflectors located between two neighboring comb tooth-shaped sections are disposed at relatively inner and outer positions.

BRIEF DESCRIPTION OF THE DRAWINGS

The above and other objects and features of the present invention will become apparent from the following description of preferred embodiments, given in conjunction with the accompanying drawings, in which.

DETAILED DESCRIPTION OF THE PREFERRED EMBODIMENT

Hereinafter, preferred embodiments of the hair trimmer in accordance with the present invention will be described with reference to the accompanying drawings.

Figure 2:
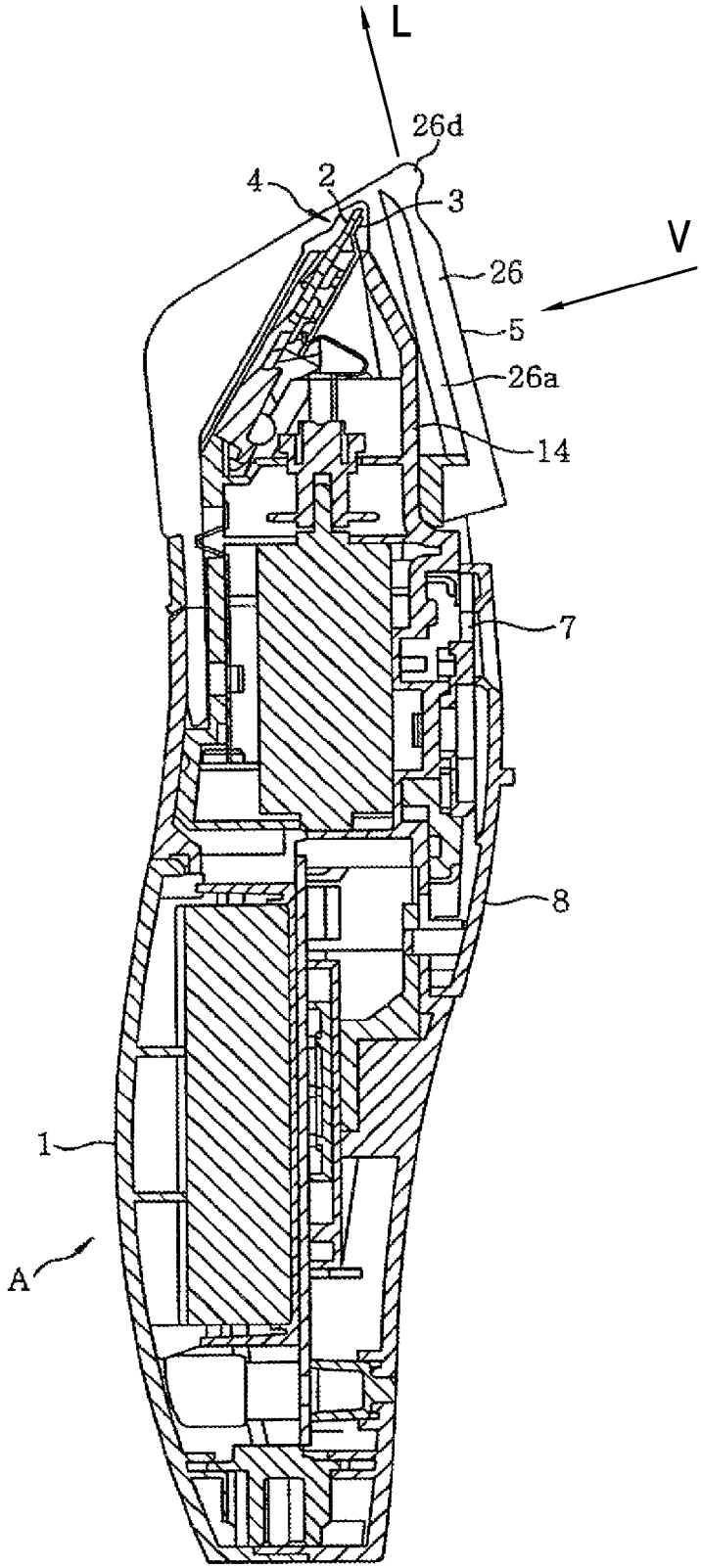
FIG. 2 describes a cross-sectional side view of the aforementioned hair trimmer in accordance with the present invention.

A hair trimmer A is constructed in such a way that a cutter block 4 having a stationary blade 2 in combination with and a movable blade 3, which is movable in a sliding direction S that extends into and out of the page when viewing FIG. 2, both of which are comb-shaped and slidably in contact with each other, is protrudingly disposed at one end portion in the lengthwise direction of an approximately cylindrical main body 1 which extends from the one end to the other end portion. A comb attachment 5 for trim length adjustment, having a plurality of comb tooth-shaped sections 26, movably covers the cutter block 4 along a projected direction of the cutter block 4.

The hair trimmer is configured as follows in order that the comb attachment 5 is installed to movably cover the cutter block 4 along the projected direction of the cutter block 4.

Figure 4A:
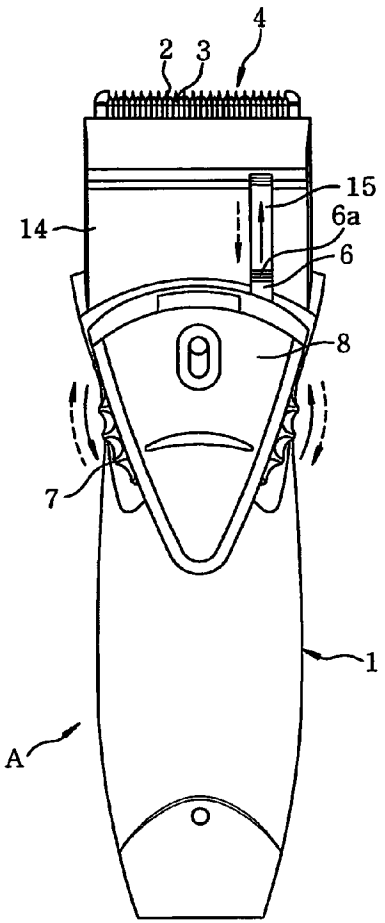
FIGS. 4A to 4C represent a front view, a left side view and a rear view of the hair trimmer in accordance with the present invention, respectively, wherein the comb attachment of the hair trimmer is detached from the hair trimmer.
Figure 4B:
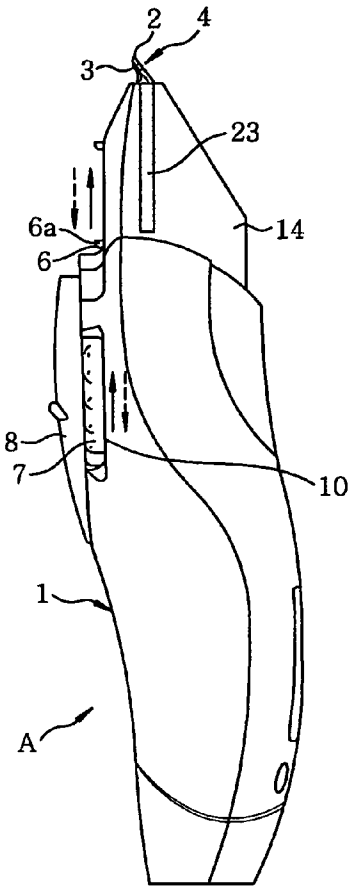
Figure 4C:
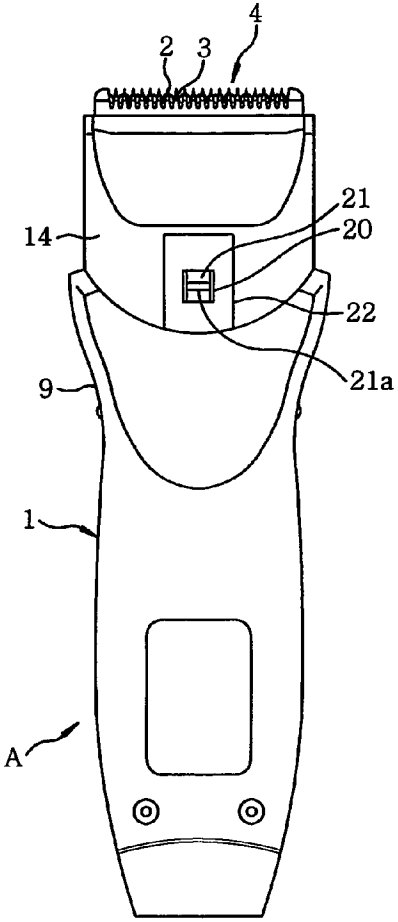

The main body 1 is formed as shown in FIGS. 4A to 4C, and among the four side-surfaces established when one end portion where the cutter block 4 is protrudingly disposed is oriented upward so that the opposite end portion points downward, a mortise 10 is provided at one of the four side-surfaces, and a rotary dial 7 for moving a connecting member 6 in a vertical direction of the main body 1 (a lengthwise direction of the main body 1) is disposed at the corresponding mortise 10. Further, an operation switch 8 for turning on/off the operation of the main body 1 is provided at the exterior of one side-surface of the main body 1 where the rotary dial 7 is provided. Furthermore, a comb attachment placement head 14 movably covered by the comb attachment 5 to be described later is positioned between the main body 1's outermost portion where the cutter block 4 is projected and the portion where the rotary dial 7 and the operation switch 8 are disposed.

Figure 1C:
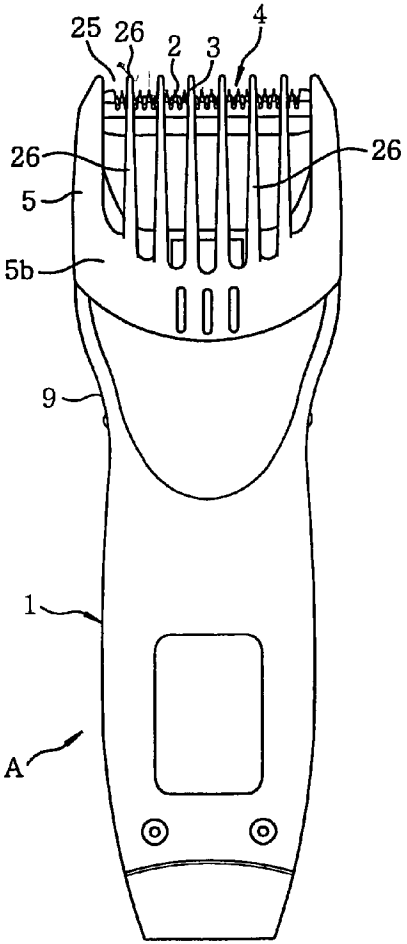
FIGS. 1A to 1C show a front view, a left side view and a rear view of a hair trimmer in accordance with the present invention, respectively.
Figure 1B:
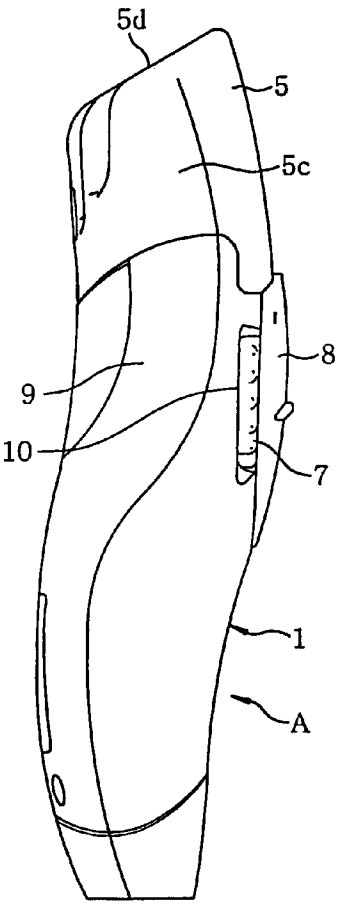
Figure 1A:
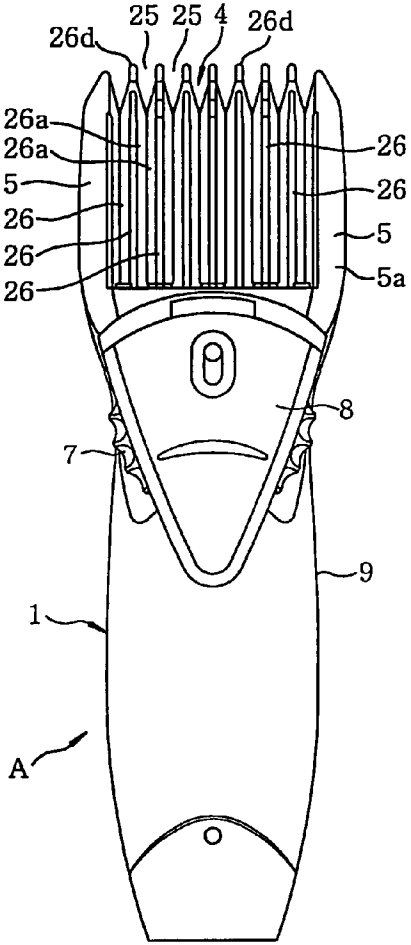

If the one side-surface of the main body 1 where the rotary dial 7 and the operation switch 8 are provided were to be defined as the front, the comb-shaped movable blade 3 of the cutter block 4 is positioned at the front side whereas the comb-shaped stationary blade 2 is positioned at the rear side behind the movable blade 3, as illustrated in FIGS. 1A to 1C. Further, a neck portion 9 having a narrow width between both side surfaces is positioned slightly off the central portion of the main body 1 toward the cutter block 4, and the rotary dial 7 and the operation switch 8 are provided at the one side-surface (front) perpendicular to both side-surfaces of the neck portion 9 having a narrow width.

Figure 3A:
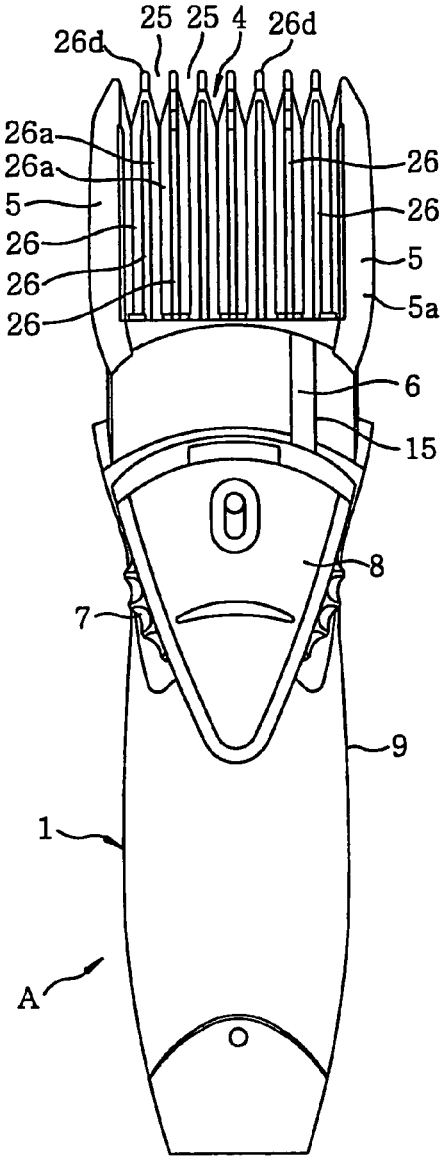
FIGS. 3A and 3B provide a front view and a cross-sectional view of the aforementioned hair trimmer in accordance with the present invention, respectively, wherein the trim length is set to be long by moving a comb attachment for trim length adjustment of the present invention.
Figure 3B:
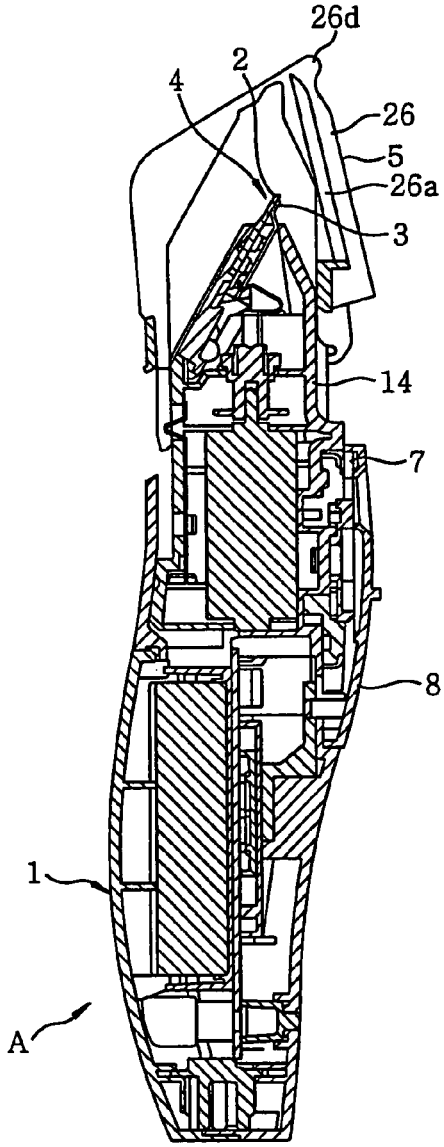

As illustrated in FIGS. 3A and 3B, the operation switch 8, seen from the front, has a triangular shape. By sliding the operation switch 8 in the vertical direction (the lengthwise direction of the main body 1) in FIGS. 3A and 3B, a switch mechanism turns on/off a driving mechanism such as a motor or a linear actuator accommodated in the main body 1, thereby driving the movable blade 3 of the cutter block 4 to reciprocate or otherwise stopping the operation thereof (the driving is turned on when the operation switch 8 is moved closer to the cutter block 4 whereas it is turned off if moved further from the cutter block 4).

Although the rotary dial 7 is mostly covered by the operation switch 8, a part of an outer circumference of the rotary dial 7 is slightly projected from both sides of the operation switch 8 at a rear side of the operation switch 8, as illustrated in FIGS. 3A and 3B. By manipulating the rotary dial 7, the connecting member 6 is moved by a linking mechanism, e.g., a rack, a pinion or the like (not shown). If the rotary dial 7 is turned as shown by a solid arrow of FIGS. 4A to 4C, the connecting member 6 moves as shown by the solid arrow. Further, if the rotary dial 7 is turned as shown by a dashed arrow, the connecting member 6 moves as shown by the dashed arrow. An engaging portion 6*a* is installed at an end portion of the connecting member 6. Further, since the connecting member 6 slides in the elongated groove 15 provided at a front side of the comb attachment placement head 14, the engaging portion 6*a* at the end portion slides along the elongated groove 15.

If the rotary dial 7 which transmits its movement to the connecting member 6 is disposed at one side surface of the main body 1 in parallel with the corresponding one side surface, and the operation switch 8 is disposed at the exterior of the same side surface of the main body 1 over the rotary dial 7 so that they can be overlapped at the same section. Thus, the length of the main body 1 can be shortened in comparison with a case where the operation switch 8 and the rotary dial 7 are disposed at different places of the main body 1 along the lengthwise direction. Further, the overall size of the main body 1 can be made smaller as a result.

As shown in FIG. 4C, the guide groove 22 is provided at a rear side of the comb attachment placement head 14. At the bottom portion of the guide groove 22, a window portion 20, which runs through externally and internally, is provided. An elastic member is installed in a housing of the main body 1, and an elastic pressing protrusion 21*a* provided at the corresponding elastic member 21 is projected out through the window portion 20.

Further, guiding rail portions 23 are provided on both left/right sides of the comb attachment placement head 14 of the main body 1 along the lengthwise direction of the main body 1.

As shown in FIGS. 5 to 8, the cylindrical comb attachment 5 has one open end portion and movably covers the comb attachment placement head 14 of the main body 1 having the cutter block 4 at one end portion thereof.

As described above, while the comb attachment placement head 14 of the main body 1 is covered by the cylindrical comb attachment 5 with one open end portion for trim length attachment, among the sides of the cylindrical comb attachment 5, if the side portion where the movable blade 3 is disposed (i.e., a side portion facing the movable blade 3) is defined as the front side portion 5*a*, the side portion facing the front side portion 5*a* (i.e., the side portion facing the stationary blade 2) becomes a rear side portion 5*b*. Further, the side portions connecting both edge portions of the front side portion 5*a* and the rear side portion 5*b* become left/right side portions 5*c*, and the side portion facing the opening (i.e., a surface portion of a leading end portion of the comb tooth-shaped section 26 provided in a direction as same as the projected direction of the cutter block 4 at one end portion of the main body 1) becomes an end surface portion 5*d*. Further, multiple rows of gaps are formed from the front side portion 5*a* to the rear side portion 5*b* via the end surface portion 5*d* to thereby form the multiple comb tooth-shaped sections 26, which extend in a length direction L.

Figure 8:
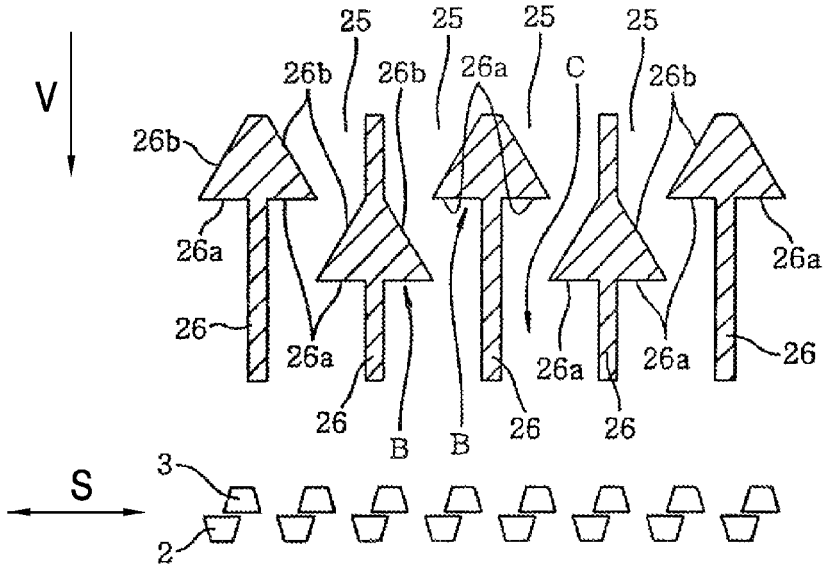
FIG. 8 illustrates an enlarged cross-sectional view of the comb attachment, which is taken along line X-X of FIG. 7.

Around the front side portion 5*a* corresponding to the side portion of the comb tooth-shaped section 26 facing the movable blade 3, cut-off hair deflectors 26*a* are projected from the comb tooth-shaped sections 26 toward adjacent comb tooth-shaped sections 26 has shown in FIG. 8, surfaces of the hair deflectors 26*a* viewed in a direction from an opposite side of the cutter block with respect to the comb tooth-shaped sections are inclined with respect to the view direction V, the view direction V being perpendicular to the direction L of the length of the comb tooth-shaped sections and the sliding direction S of the movable blade); preferably, the deflectors are formed on both sides of and are symmetrical about each comb tooth-shaped section. Further, the cut-off hair deflectors 26*a* provided extend from the portion near the opening and to a leading end portion of the comb tooth-shaped section 26 in the direction equal to the projected direction of the cutter block 4. Further, the cut-off hair deflectors 26*a* of the adjacent comb tooth-shaped sections 26 are arranged so that they are formed at different positions with respect to the direction approximately perpendicular to the projected direction of the cutter block 4 at one end portion of the main body 1 and the sliding direction of the movable blade 3, respectively. That is, in case the cutter block 4 were to be an inner portion whereas the exterior of the comb attachment 5 were to be an outer portion, the cut-off hair deflectors 26*a* located between two neighboring comb tooth-shaped sections are disposed at relatively inner and outer positions, as shown in FIG. 8.

In case the cut-off hair deflectors 26*a* of the adjacent comb tooth-shaped sections 26 are viewed from the outside, it is preferable that leading ends of the cut-off hair deflectors 26*a* are adjacent to each other or overlapping in order to prevent cut-off hairs from scattering out. However, as described above, since the cut-off hair deflectors 26*a* located between two neighboring comb tooth-shaped sections 26 are disposed at relatively inner and outer positions, even if the leading ends of the cut-off hair deflectors 26*a* viewed from the outside are adjacent to each other or overlapping, the free space from a protruded leading end portion of the cut-off hair deflectors 26*a* to a side portion of the adjacent comb tooth-shaped sections 26 can be provided wide enough to bring in hairs without obstruction.

An engager portion 27 is disposed on the inner surface of the front side portion 5*a* of the cylindrical comb attachment 5. The engager portion 27 is engaged with the engaging portion 6*a* of the connecting member 6 while the cylindrical comb attachment 5 is covering the comb attachment placement head 14 of the main body 1. Further, guided rail portions 28 are disposed on inner surfaces of the left/right side portions 5*c* and slidably inserted into the guiding rail portions 23 provided on the comb attachment placement head 14 while the cylindrical comb attachment 5 is covering the comb attachment placement head 14 of the main body 1.

Further, a flat plate-shaped pressure receiving element 29 is provided at the rear side portion 5*b* of the cylindrical comb attachment 5 and projected from the inner surface of the rear side portion 5*b* toward the opposite direction of the end surface portion 5*d* via the open end. Further, the pressure receiving element 29 is slidably fitted into the guide groove 22 and, at the same time, an elastic pressing protrusion 21 of the elastic member projecting through the window portion 20 is elastically in contact with the pressure receiving element 29 while covering the comb attachment placement head 14 of the main body 1 with the cylindrical comb attachment 5. The pressing direction on the pressure receiving element 29 by the elastic pressing protrusion 21 of the elastic member is perpendicular to the moving direction of the comb attachment 5 (in this case, the perpendicular direction in the present invention includes an approximately perpendicular direction) Further, the comb attachment 5 is elastically in contact with the comb attachment placement head 14 regardless of the comb attachment 5's location relative to the comb attachment placement head 14. Accordingly, even if the comb attachment 5 is sized slightly loosely relative to the main body 1 so that it moves easily on the main body 1, the comb attachment 5 is always elastically pressed by the elastic member perpendicular to the sliding direction of the comb attachment 5 so that the cylindrical comb attachment 5 does not rattle on the comb attachment placement head 14, thereby eliminating a rattling noise.

A step-by-step use of the hair trimmer A movably having the comb attachment 5 configured as described above will be described hereinafter.

Namely, while holding the main body 1 with one hand, the trim length is adjusted by turning the rotary dial 7 so that the comb attachment 5 would move in the projected direction of the cutter block 4. By manipulating the operation switch 8, the movable blade 3 is turned on, and hair or beard brought in from the hair introducing gaps 25 between the comb tooth-shaped sections 26 of the comb attachment 5 is cut by the stationary blade 2 and the movable blade 3 at a desired trim length.

Hairs cut by the cutter block 4 of the comb attachment 5 tends to scatter away due to cutting vibrations stress of the blades. Since, however, the cut-off hair deflectors 26*a* are provided as described above, and, further, the cut-off hair deflectors 26*a* located between two neighboring comb tooth-shaped sections 26 are disposed at relatively inner and outer positions, the cut-off hair contact with the cut-off hair deflectors 26*a* as shown by an arrow B of FIGS. 8 to 10 and, thus, are prevented from scattering away. In this case, since the cut-off hair deflectors 26*a* located between two neighboring comb tooth-shaped sections 26 are disposed at relatively inner and outer positions, such cut-off hair deflectors 26*a* can prevent the hairs from scattering out while providing the width of the hair introducing gaps 25 wide enough to bring in hair without obstruction. As a result, the structures do not interfere with getting hairs into the comb attachment and cutting them while the cut-off hairs are prevented from scattering out.

As illustrated in FIG. 8, by employing an outward surface of the cut-off hair deflector 26*a* installed at the comb tooth-shaped section 26 as the hair introducing inclined surface 26*b* for bringing in hair, a width of a portion formed between the hair introducing inclined surface 26*b* and a side portion of the adjacent comb tooth-shaped section 26 facing thereto in the hair introducing gap 25 becomes wider toward an outer portion and, further, the cut-off hair deflectors 26*a* are disposed at relatively inner and outer positions. Accordingly, as shown by an arrow C in FIG. 8, it is possible to smoothly bring in hair toward the cutter block while reducing obstruction between hairs and the comb tooth-shaped sections 26 in the curved hair introducing gaps 25 ranging from an opening to an exit of an introducing side.

Figure 9:
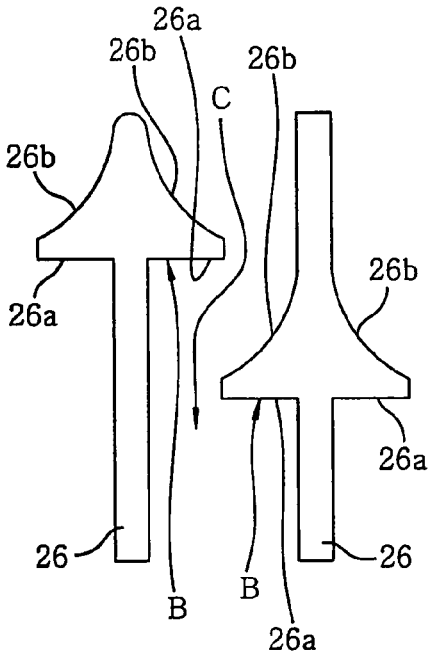
FIG. 9 shows an explanatory diagram of another preferred embodiment of a comb tooth-shaped section to which cut-off hair deflectors are formed in the comb attachment used in the hair trimmer of the present invention.

Further, as illustrated in FIG. 9, in case the hair introducing inclined surface 26*b* is inclined in the shape of a concave surface, the spaces for bringing in hairs at the outer side portion of the hair introducing inclined surface 26*b* is increased, thereby further reducing obstruction against hairs getting into the hair introducing gaps 25 to be trimmed.

Figure 10:
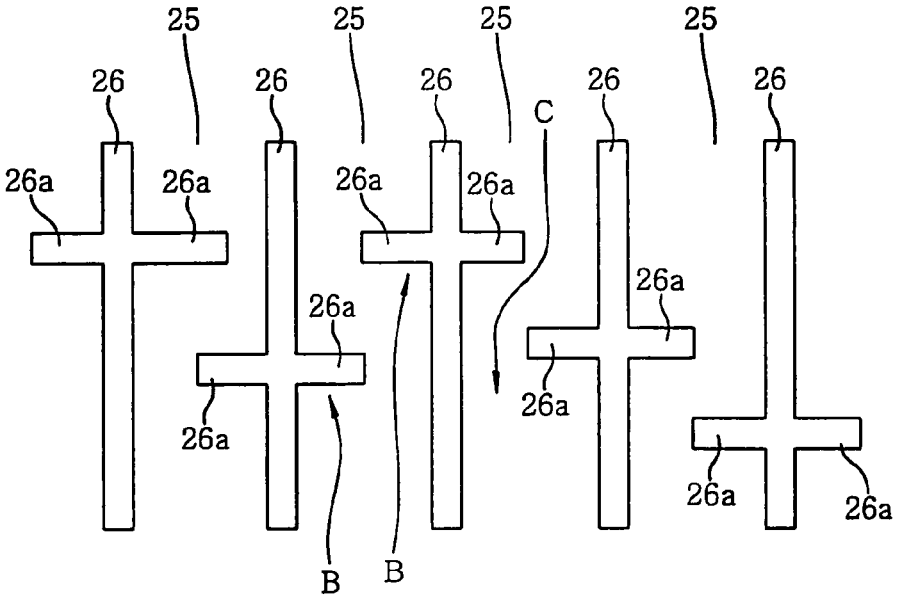
FIG. 10 depicts an explanatory diagram of still another preferred embodiment of a comb tooth-shaped section to which cut-off hair deflectors are formed in the comb attachment used in the hair trimmer of the present invention.

In the present invention, the cut-off hair deflectors 26*a* provided at the comb tooth-shaped section 26 may not have the hair introducing inclined surface 26*b*, as shown in FIG. 10.

Figure 11:
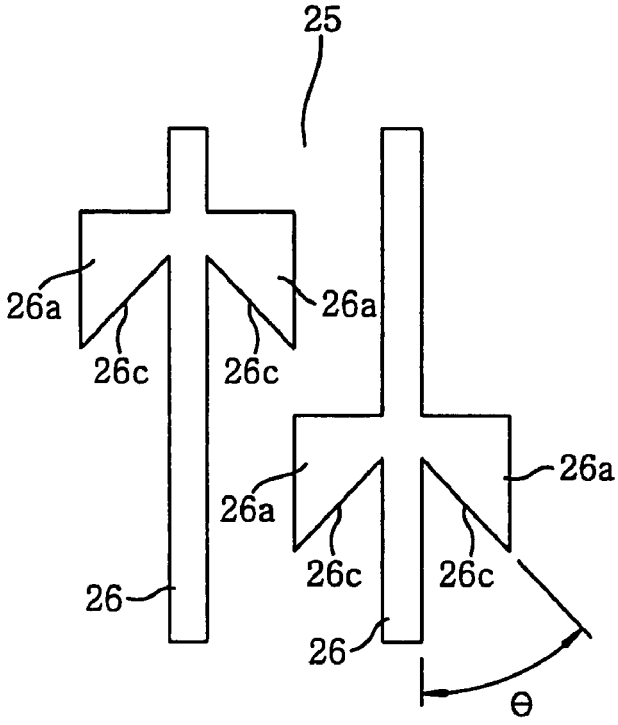
FIG. 11 describes an explanatory diagram of still another preferred embodiment of a comb tooth-shaped section to which cut-off hair deflectors are formed in the comb attachment used in the hair trimmer of the present invention.

Further, with regard to cut-off hairs coming in contact with the cut-off hair deflectors 26*a* and then are prevented from scattering away, the surface facing the cutter block 4 of the cut-off hair deflectors 26*a* can be formed with the cut-off hair deflecting surface 26*c* which is inclined in a manner that the base side of the cut-off hair deflector 26*a* is disposed farther away from the cutter block 4 (the cut-off hair deflecting surface 26*c* forms an acute angle θ with the comb tooth-shaped section 26), as illustrated in FIG. 11. Thus, hairs contacting with the cut-off hair deflectors 26*a* are cut and then deflected toward the base corner between the deflectors and the comb tooth-shaped sections by the cut-off hair deflecting surface 26*c* of the cut-off hair deflector 26*a*. As a result, it is made even more difficult for cut-off hairs to pass through the protruded leading ends of the cut-off hair deflectors 26*a* and to scatter away to the surrounding area from the hair introducing gaps 25.

Figure 7:
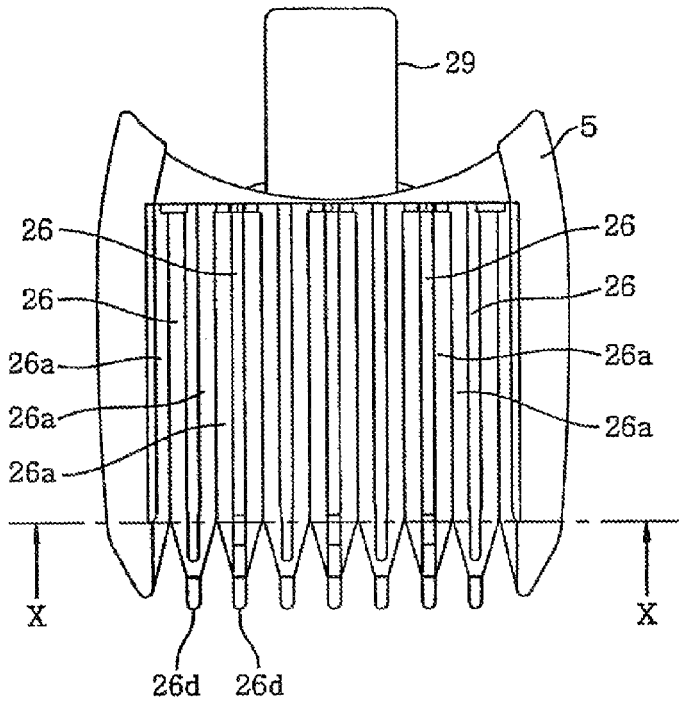
FIG. 7 is a front view of the aforementioned comb attachment.

As illustrated in FIG. 7, in a leading end portion of the comb tooth-shaped section 26 provided in a direction equal to the projected direction of the cutter block 4 at one end portion of the main body 1 of the comb tooth-shaped section 26 having the cut-off hair deflector 26*a*, the cut-off hair deflector 26*a*, seen from the front, is formed in an approximately triangular shape wherein the width of the cut-off hair deflector 26*a* in the leading end portion becomes narrower toward a leading end of the comb tooth-shaped section 26. Accordingly, the amount of hair brought in one time through the front end portion of the comb tooth-shaped sections 26 provided in a direction equal to the projected direction of the cutter block 4 at one end portion of the main body 1 increases, so that further reducing obstruction against hairs getting into the hair introducing gaps 25 to be trimmed.

Figure 5:
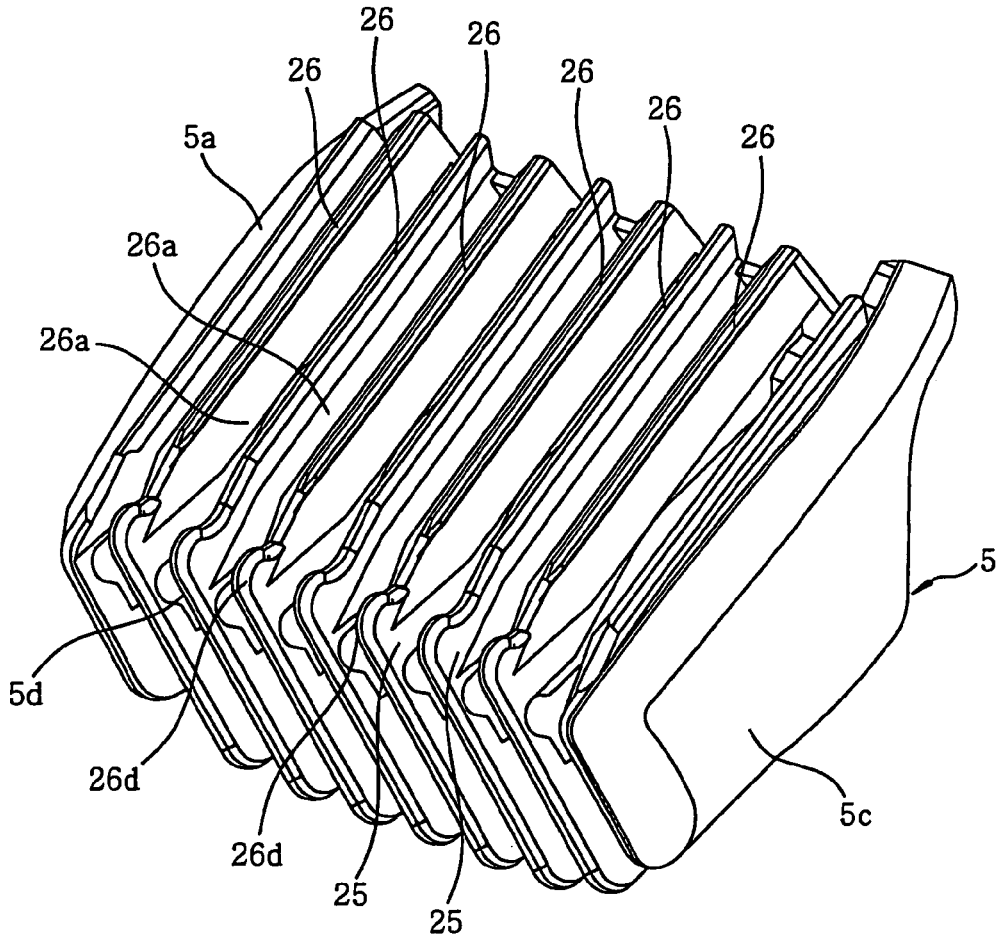
FIG. 5 represents a perspective view of a front portion of the comb attachment used in the hair trimmer of the present invention.
Figure 6A:
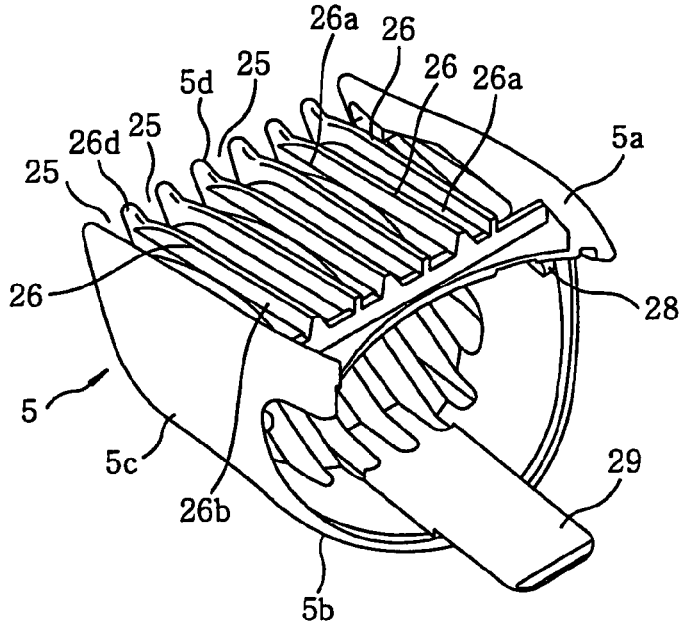
FIGS. 6A and 6B present a perspective view and an inverted perspective view of a rear portion of the comb attachment used in the hair trimmer of the present invention, respectively.
Figure 6B:
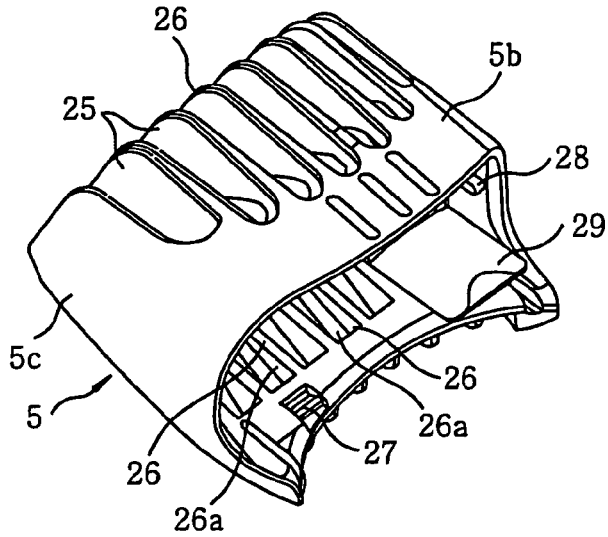
Figure 12:
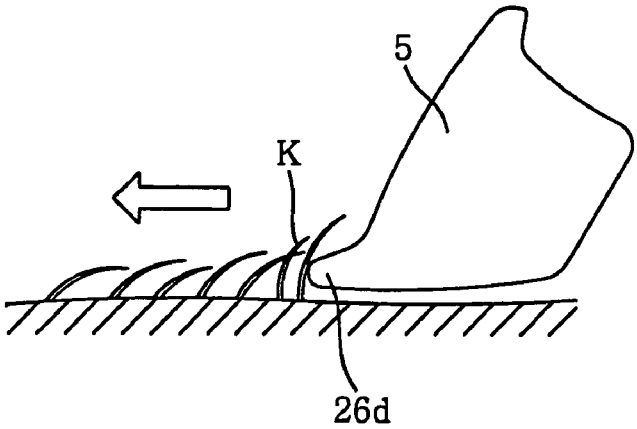
FIG. 12 provides an explanatory diagram illustrating a state where hairs are lifted.

Further, as depicted in FIGS. 5 and 6A, a sharp-shaped hair-lifting guide 26*d* is provided at an outermost end of the comb tooth-shaped section 26 provided in a direction equal to the projected direction of the cutter block 4 at one end portion of the main body 1. Accordingly, when hair is brought in through the leading end portion of the comb tooth-shaped sections 26, hair can be brought in while being lifted by the hair-lifting guide 26*d* as shown in FIG. 12 (in FIG. 12, K indicates hair, and an arrow represents a moving direction of the hair trimmer A), so that the hair lifting effect can be obtained.

Figure 13:
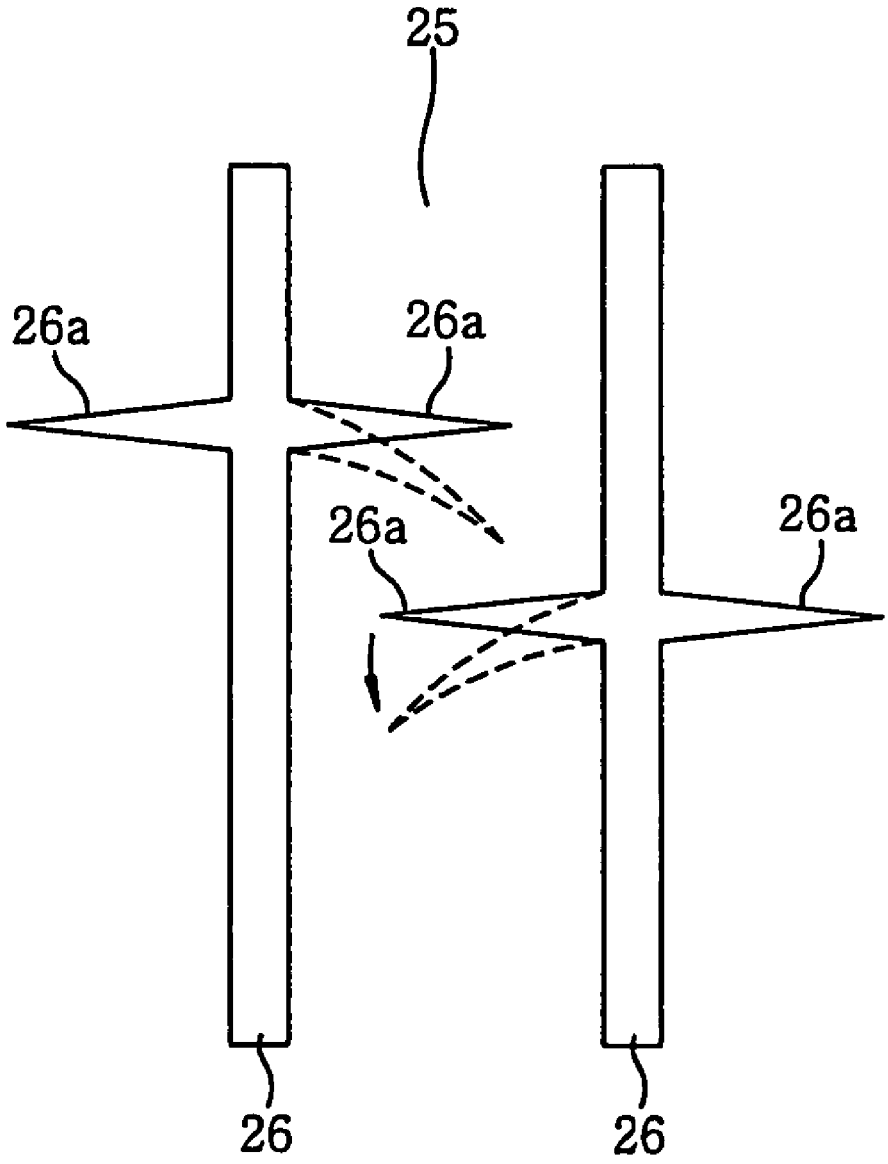
FIG. 13 presents an explanatory diagram of still another preferred embodiment of a comb tooth-shaped section to which cut-off hair deflectors are formed in the comb attachment used in the hair trimmer of the present invention.

In the aforementioned embodiments, as illustrated in FIG. 13, the cut-off hair deflectors 26*a* can be formed of synthetic resin such as vinyl chloride, a paper, or an elastic member having deformability, e.g., a thin rubber such as elastomer or the like.

If the cut-off hair deflectors 26*a* are formed of an elastic member that is flexible, the hair brought in from the hair introducing gaps between the adjacent comb tooth-shaped sections 26 can pass through the cut-off hair deflector 26*a* by pushing back the cut-off hair deflector 26*a* made of an elastic member. Accordingly, as illustrated in FIG. 13, even if the cut-off hair deflectors 26*a* of the adjacent comb tooth-shaped sections 26, seen from the outside (front), are overlapped, the hair can be brought in by bending the cut-off hair deflectors 26*a* having the elasticity as shown by a dashed line in FIG. 13 and, further, the outward overflow of cut-off hair can be further prevented.

Figure 14:
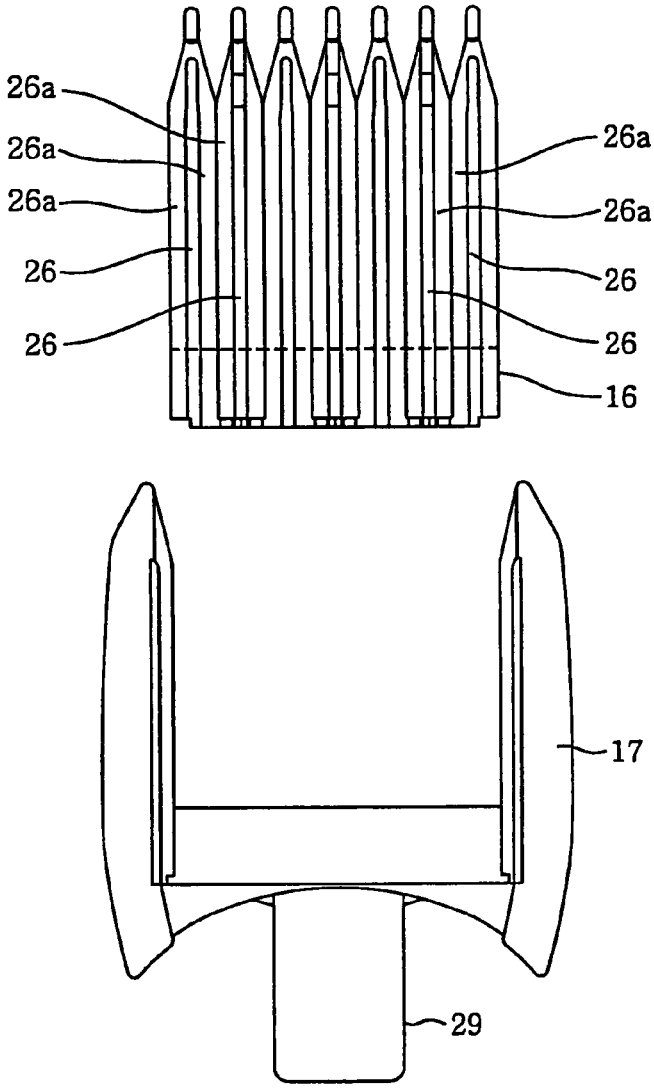
FIG. 14 represents an exploded front view of still another preferred embodiment of a comb attachment used in the hair trimmer of the present invention.

In each of the aforementioned embodiments of the comb attachment 5, as described in FIG. 14, the comb attachment 5 includes a comb frame body 17 and a comb-shaped section block 16 having a plurality of comb tooth-shaped sections 26 apart from the comb frame body 17, wherein the comb-shaped section block 16 can be fixed to the comb frame body 17 by a fixing mechanism such as a thermal bonding, e.g., an ultrasonic thermal bonding or the like, an adhesive, and an insertion-fitting. In other words, in case the comb attachment 5 having a configuration in which the cut-off hair deflectors 26*a* of the adjacent comb-shaped sections 16 are disposed inwardly and outwardly is formed as one body by a single die, the shape of the comb attachment 5 becomes complex due to such a configuration of the cut-off hair deflectors 26*a* of the adjacent comb tooth-shaped sections 26, thereby complicating a forming die and increasing costs thereof. Accordingly, by forming the comb frame body 17 and the comb-shaped section block 16 with the use of separate dies and then fixing them with a fixing mechanism, the dies can be simplified and, thus, the comb attachment 5 can be formed in a simple structure.

Figure 15:
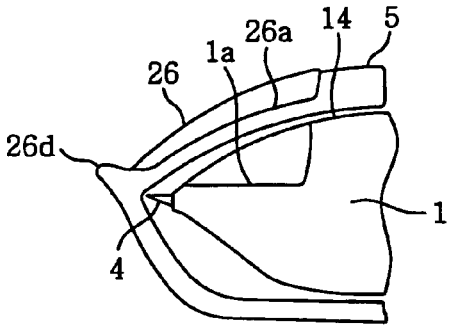
FIG. 15 shows a schematic cross-sectional view illustrating an exemplary receiving portion for receiving cut-off hairs.

Moreover, if a receiving portion la for receiving therein cut-off hairs is provided by providing a chamber at the front side of the comb attachment placement head 14 of the main body 1 as shown in FIG. 15, the cut-off hairs contact with the cut-off hair deflectors 26*a* and, then, accumulate in the receiving portion 1*a*, so that collection of cut-off hairs can be improved.

Figure 16A:
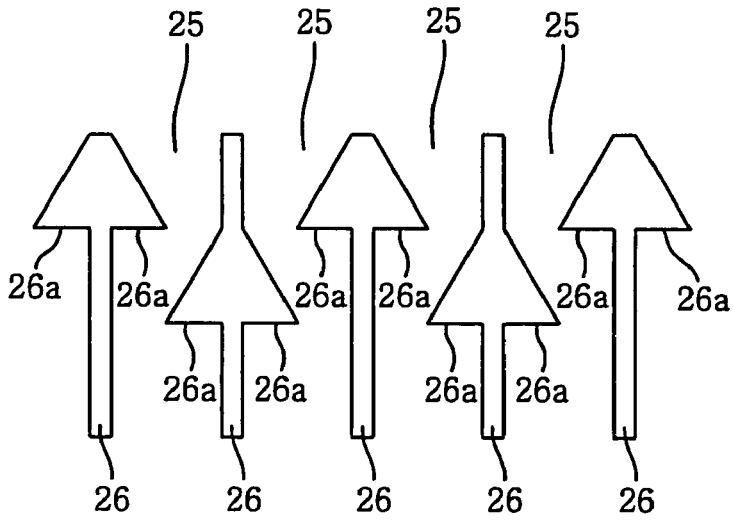
FIG. 16A depicts a front view of the comb tooth-shaped section in a state where a part of the comb tooth-shaped section is not taken apart from the comb attachment used in the hair trimmer of the present invention, and FIG. 16B provides a front view of the comb tooth-shaped section in a state where a part of the comb tooth-shaped section is taken apart therefrom.
Figure 16B:
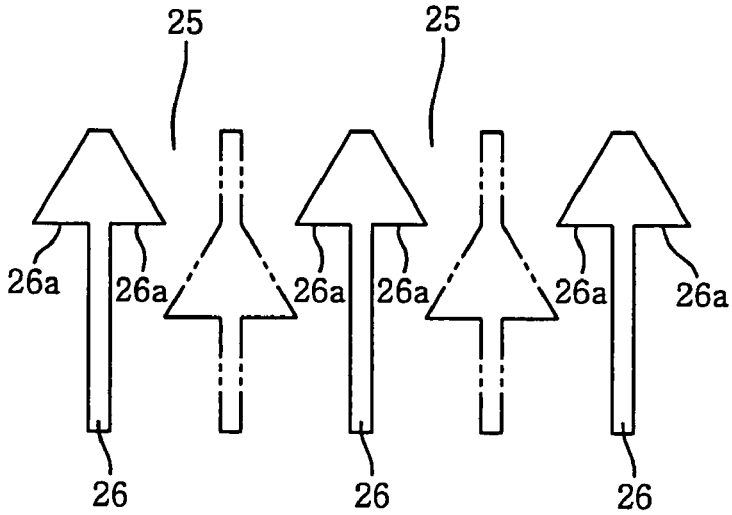

Furthermore, an entire or a part of the multiple comb tooth-shaped sections 26 installed at the comb attachment 5 may be detachable from the comb frame body 17. In this case, it is possible to vary a width of the hair introducing gaps 25 depending on demands of a user by replacing the comb tooth-shaped section 26 with another one having a different width of the hair introducing gaps 25 or separating a part of the comb tooth-shaped section 26 as shown from FIG. 16A to FIG. 16B (in this embodiment, every other comb tooth-shaped section 26 is separated).

The present invention has a simple structure in which cut-off hair deflectors located between two neighboring comb tooth-shaped sections are disposed at relatively inner and outer positions and, further, is able to prevent cut-off hair from scattering away to the surrounding area with the help of such cut-off hair deflectors while efficiently bringing in hair.

While the invention has been shown and described with respect to the preferred embodiments, it will be understood by those skilled in the art that various changes and modification may be made without departing from the spirit and scope of the invention as defined in the following claims.

What is claimed is:

1. A hair trimmer comprising:

a main body;

a cutter block having a stationary blade and a movable blade, both of which are comb-shaped and are slidably in contact with each other, the cutter block being protrudingly installed at one end of the main body; and a comb attachment having a plurality of comb tooth-shaped sections, wherein the cutter block is accommodated in the comb attachment;

wherein the comb tooth-shaped sections are provided with cut-off hair deflectors each having substantially the same size and extending along a length of the comb tooth-shaped sections from a first end portion to an opposed second end portion thereof to introduce hairs into the comb attachment while preventing hairs cut by the cutter block from outwardly scattering away from the comb attachment; and wherein surfaces of all the hair deflectors viewed in a direction from an opposite side of the cutter block with respect to the comb tooth-shaped sections are inclined with respect to the view direction, the view direction being perpendicular to a direction of the length of the comb tooth-shaped sections and a sliding direction of the movable blade, and the cut-off hair deflectors located between two neighboring comb tooth-shaped sections are disposed at different distances from the cutter block with respect to each other.

2. The hair trimmer of claim 1, wherein the hair introducing inclined surface is a concavely curved surface.

3. The hair trimmer of claim 1, wherein each of the cut-off hair deflectors has an inclined inward surface facing the cutter block, the inward surface serving as a cut-off hair deflecting surface and a part of the inward surface closer to a base side of each of the cut-off hair deflectors is disposed farther away from the cutter block.

4. The hair trimmer of claim 1, wherein each of the comb tooth-shaped sections disposed in a protruding direction of the cutter block is provided with a leading end portion and a width of each of the cut-off hair deflectors in the leading end portion becomes narrower toward a leading end of said each of the comb tooth-shaped sections.

5. The hair trimmer of claim 1, wherein a protruded hair-lifting guide is provided at an outermost end portion of a comb tooth-shaped section disposed in a protruding direction of the cutter block.

6. The hair trimmer of claim 1, wherein the cut-off hair deflectors are formed of an elastically deformable resilient material.

7. The hair trimmer of claim 1, wherein the comb attachment includes a comb frame body and a comb tooth-shaped section block having the comb tooth-shaped sections, the comb tooth-shaped section block being fixed to the comb frame body by a fixing mechanism.

8. The hair trimmer of claim 1, wherein the main body includes a receiving portion for collecting therein cut-off hairs.

9. The hair trimmer of claim 1, wherein the cut-off hair deflectors are formed at different positions with respect to the direction perpendicular to the projected direction of the cutter block and the sliding direction of the movable blade.

10. The hair trimmer of claim 1, wherein each of the cut-off hair deflectors is projected from one of said two neighboring comb tooth-shaped sections toward the other of said two neighboring comb tooth-shaped sections.

11. The hair trimmer of claim 10, wherein the cut-off hair deflectors are formed on both sides of and are symmetrical about each comb tooth-shaped section.

12. The hair trimmer of claim 1, wherein each of the comb tooth-shaped sections includes one cut-off hair deflector projected toward one of its neighboring comb tooth-shaped sections, said one cut-off hair deflector being extended along a protruding direction of the cutter block, and having a body portion with a uniform width and an end portion with a reduced width, the body portion being disposed closer to the main body than the end portion is.

13. The hair trimmer of claim 1, wherein the cut-off hair deflectors located between two neighboring comb tooth-shaped sections are disposed at the different planes relative to a line approximately perpendicular to a projected direction of the cutter block.

14. The hair trimmer of claim 1, wherein the comb tooth-shaped sections are provided above the cutter block.

15. A hair trimmer comprising:

a main body;

a cutter block having a stationary blade and a movable blade, both of which are comb-shaped and are slidably in contact with each other, the cutter block being protrudingly installed at one end of the main body; and a comb attachment having a plurality of comb tooth-shaped sections, wherein the cutter block is accommodated in the comb attachment wherein the comb tooth-shaped sections are provided with cut-off hair deflectors each having substantially the same size and which are located between two neighboring comb tooth-shaped sections and which extend along a length of the comb tooth-shaped sections from a first end portion to an opposed second end portion thereof to introduce hairs into the comb attachment while preventing hairs cut by the cutter block from outwardly scattering away from the comb attachment;

wherein each of the cut-off hair deflectors is projected from one of said two neighboring comb tooth-shaped sections toward the other of said two neighboring comb tooth-shaped sections and wherein surfaces of all the hair deflectors viewed in a view direction from an opposite side of the cutter block with respect to the comb tooth-shaped sections are inclined with respect to the view direction, the view direction being perpendicular to a direction of the length of the comb tooth-shaped sections and a sliding direction of the movable blade and the cut-off hair deflectors located between two neighboring comb tooth-shaped sections being disposed at different distances from the cutter block with respect to each other.

16. The hair trimmer of claim 15, wherein each of the comb tooth-shaped sections disposed in a protruding direction of the cutter block is provided with a leading end portion and a width of each of the cut-off hair deflectors in the leading end portion becomes narrower toward a leading end of said each of the comb tooth-shaped sections.

17. The hair trimmer of claim 15, wherein a protruded hair-lifting guide is provided at an outermost end portion of a comb tooth-shaped section disposed in a protruding direction of the cutter block.

18. The hair trimmer of claim 15, wherein the main body includes a receiving portion for collecting therein cut-off hairs.

19. The hair trimmer of claim 15, wherein each of the comb tooth-shaped sections includes one cut-off hair deflector projected toward one of its neighboring comb tooth-shaped sections, said one cut-off hair deflector being extended along a protruding direction of the cutter block, and having a body portion with a uniform width and an end portion with a reduced width, the body portion being disposed closer to the main body than the end portion is.

20. The hair trimmer of claim 15, wherein the cut-off hair deflectors are disposed at the different planes relative to a line approximately perpendicular to a projected direction of the cutter block.

21. The hair trimmer of claim 15, wherein the comb tooth-shaped sections are provided above the cutter block.

* * * * *